US009751598B2

(12) United States Patent
Huarcaya-Pro

(10) Patent No.: US 9,751,598 B2
(45) Date of Patent: Sep. 5, 2017

(54) SURFBOARD AND METHOD OF MANUFACTURE

(71) Applicant: Javier Huarcaya-Pro, Carlsbad, CA (US)

(72) Inventor: Javier Huarcaya-Pro, Carlsbad, CA (US)

( * ) Notice: Subject to any disclaimer, the term of this patent is extended or adjusted under 35 U.S.C. 154(b) by 0 days.

(21) Appl. No.: 15/367,573

(22) Filed: Dec. 2, 2016

(65) Prior Publication Data

US 2017/0158295 A1 Jun. 8, 2017

Related U.S. Application Data

(60) Provisional application No. 62/262,826, filed on Dec. 3, 2015.

(51) Int. Cl.
*B63B 35/79* (2006.01)
*B26F 1/24* (2006.01)
*B26F 3/08* (2006.01)

(52) U.S. Cl.
CPC ..... *B63B 35/7909* (2013.01); *B26F 1/24* (2013.01); *B26F 3/08* (2013.01); *B63B 35/7926* (2013.01)

(58) Field of Classification Search
CPC ..... B63B 35/7909
USPC ..... 441/74
See application file for complete search history.

(56) References Cited

U.S. PATENT DOCUMENTS 4,964,825 A * 10/1990 Paccoret ..... B63B 35/7906 114/39.14
8,979,604 B1 * 3/2015 Woolley ..... B63B 35/7909 114/253
2004/0192127 A1 * 9/2004 Huarcaya-Pro ..... B26F 1/24 441/74
2017/0158295 A1 * 6/2017 Huarcaya-Pro ..... B63B 35/7909

* cited by examiner

*Primary Examiner* — Lars A Olson
*Assistant Examiner* — Jovon Hayes
(74) *Attorney, Agent, or Firm* — Gary L. Eastman, Esq.; Eastman & McCartney LLP

(57) ABSTRACT

A surfboard includes a core covered with a laminate and having curved perforations in the deck area and the tail area of the surfboard, in order to prevent air blisters from forming between the core and laminate. The curved perforations are deformable under pressure to minimize the opening of the perforations to inhibit liquid from entering and maximizing under zero pressure to allow the maximum amount of trapped liquid and gasses from escaping. The core is formed from an extruded closed-cell polystyrene foam block that has been shaped by restraining it against a shaped form using shaped restraining tools and straps, and heating it; and by cutting using a hot wire. The core is laminated with FIBER-GLAS® and epoxy resin, and the perforations are formed using a perforating tool that has a planar or curved working surface and one or more heated needles extending perpendicularly from the working surface.

13 Claims, 15 Drawing Sheets

SURFBOARD AND METHOD OF MANUFACTURE

RELATED APPLICATION

This application claims the benefit of priority to the U.S. Provisional Patent Application for "Improved Surfboard and Method of Manufacturing," Ser. No. 62/262,826, filed on Dec. 3, 2015.

FIELD OF THE INVENTION

The present invention relates generally to water sports equipment. The present invention relates more particularly, though not exclusively, to a water sports board made of laminated closed-cell foam with perforation vents in the laminate for preventing deformations of the surface of the board. The present invention is useful for surfboards, sailboards, wave skis, and other applications requiring buoyant, rigid, and durable boards.

BACKGROUND OF THE INVENTION

Many water sports boards and craft (e.g., surfboards, sailboards, wave skis, etc.) are made of expanded open-cell rigid polymer foam. Where the discussion herein refers to a surfboard or "board", it applies to surfboards, sailboards, body boards, wave skis, and other types of water sports boards and craft as well. To make a board of open-cell foam, a "molded method" is often used. Specifically, in using the molded method, a mold of the board is filled with liquid foam, which expands to fill the mold. The foam is then allowed to harden in the mold until it is rigid, forming a foam blank. The rigid foam is made of air cells that are open to each other. The cells at the surface of the rigid foam are also open to the atmosphere. Another method of board formation is the traditional hand-shaping method wherein the board is cut, or shaped, from a block of expanded foam to form the foam blank. To protect the foam blank from deterioration, a sealing layer is applied to the surface to protect the foam blank from the elements. The sealing layer is often made with materials such as fiberglass cloth and epoxy resins.

A problem with surfboards made with foam blanks with a sealing layer is the possibility of delamination, where the sealing layer separates from the foam blank. The repeated use of a surfboard may cause an indentation where a user places their feet, which may separate the sealing layer from the foam. Further, excessive heat will cause trapped gasses in the interior of the surfboard to expand separating the sealing layer from the foam blank and creating bubbles in the surfboard. Additionally, the inadvertent application of a large force, such as dropping the board on a hard floor or hitting the edge of the board on a rock, will damage the sealing layer and separate it from the foam. If the initial stages of delamination are not addressed, the small local areas of delamination can grow into larger delaminated areas thereby compromising the integrity of the surfboard.

Unfortunately, even though covered with a sealing layer, in the event the board is delaminated and the sealing layer is breached, the board may absorb water through that breach. When the open-cell foam has absorbed water, the open-cell foam is much heavier than when it is dry. A board made with open-cell foam that has absorbed water is significantly more difficult to use because of its increased weight and decreased buoyancy. Furthermore, a board that has absorbed water must be dried out before it is stored, in order to avoid deterioration of the board. Additionally, as trapped water and gases expand due to heat, the increased volume created by the expansion of the water and gas will cause the sealing layer to further delaminated from the foam.

In light of the above, it would be advantageous to make a board with the ability to prevent the delamination of the sealing layer of a surfboard. It would further be advantageous to make a board having similar buoyancy, rigidity, and durability characteristics of a board made from open-cell foam, yet does not absorb water into the foam material if the waterproofing material is breached.

SUMMARY OF THE INVENTION

The advantages of open-cell foam can be obtained, and its disadvantages avoided, by using closed-cell foam in its place. Closed-cell foam is extruded, and then formed into the shape of a board by hand shaping by a professional board shaper, or by using CNC machining into the desired board shape, instead of expansion into a mold as is the process used with open-cell foam. In a preferred embodiment, closed-cell foam may be made of polystyrene. An advantage of closed-cell foam is that it does not substantially absorb water. A board made of closed-cell foam does not become substantially heavier due to water absorption, and retains its physical properties, including buoyancy and ease of use for water sports and other purposes. Closed-cell foam also dries out much more quickly than open-cell foam, without yellowing or damage areas.

The present invention includes a surfboard made of laminated closed-cell foam. The laminate creates a sealing layer on the foam blank and is perforated at multiple locations on the surfboard to promote the venting of trapped gases and water vapor in the interior of the surfboard. The perforations are formed in the sealing layer with an angle or curve. The location and orientation of the perforations minimizes the amount of water entering into the surfboard. When not in use, the perforations allow air or gas to escape from between the laminate and foam. This avoids the formation of air blisters, thus overcoming a disadvantage to the use of laminated closed-cell foam.

Closed-cell foam extruded into a rough board shape may be referred to as a "blank" or "block". The blank may be heated, pressed and cut into a desired shape. The shaped blank may be laminated with water-proofing materials, such as FIBERGLAS® and epoxy resins, to make the board more durable.

To make a board of the present invention, a blank is treated with heat and pressure to shape it, if desired, and to anneal the surface (close any open cells). The board is shaped by placing the blank against a shaped form, pressing the blank against the form by use of tension devices (e.g., restraining tools and straps), heating the blank using heat sources until the blank conforms to the form, and then cooling it until the blank holds its new shape. To optimize the heating of the blank, heat sources are applied to each side of the blank and controlled to deliver a consistent and even heat transfer. The heated and pressed blank may be further shaped by cutting it with a hot wire. The cut and shaped blank or "core" is laminated with FIBERGLAS® and epoxy resin. Once laminated, the laminate is perforated on the deck of the surfboard at multiple locations typical of the placement of a user's foot when riding a surfboard. In a typical configuration, the user places his or her foot on a forward portion of the surfboard and places his or her rear foot on a rear portion of the surfboard. The perforations are created using a tool that has a substantially planar or curved surface with multiple perforation needles extending therefrom. The perforations are formed by pressing or rolling the needled surface of the tool against the laminate thereby penetrating the laminate. The board may have one or more optional fins.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION OF THE INVENTION

Figure 1:
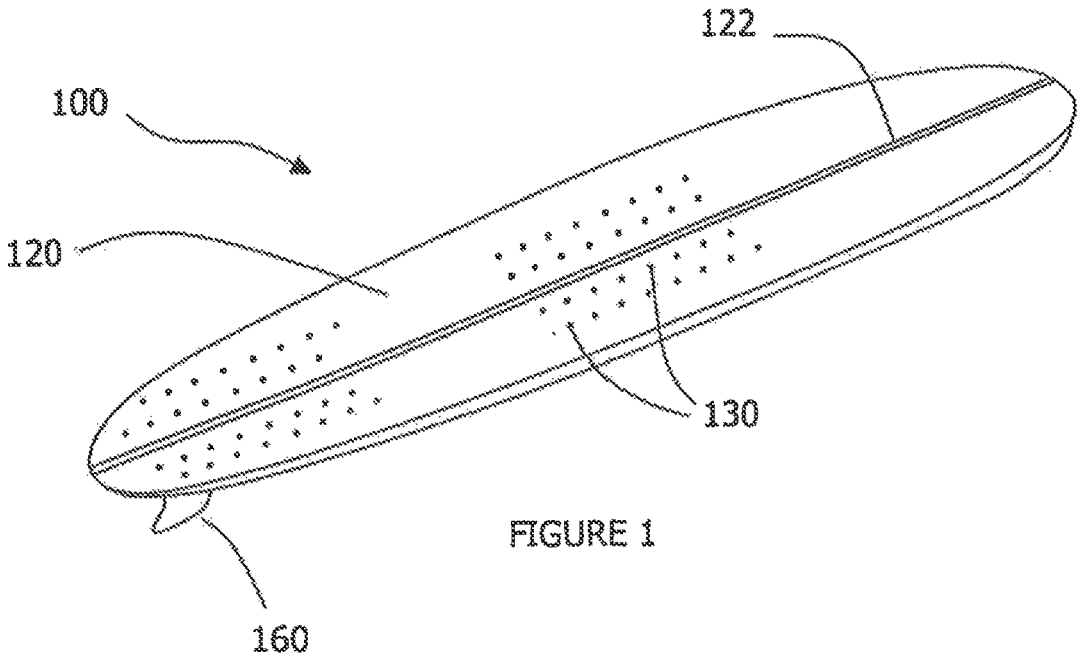
FIG. 1 is a perspective view of the Improved Surfboard and Method of Manufacturing of the present invention, showing a finished board.

A preferred embodiment of the Improved Surfboard and Method of Manufacturing of the present invention is shown in FIG. 1 and is generally designated 100. Board 100 has a foam core 110 (shown in FIG. 4), a laminate 120 covering core 110 having a stringer 122, and is formed with a number of perforations 130 in laminate 120. Core 110 of board 100 is formed by shaping a "blank". A blank is a substantially rectangular block of closed-cell foam.

Board 100 may have one or more optional fins 160. Board 100 shown in FIG. 1 is in the style of a short board. Perforations 130 are shown placed where a user would place his or her feet on board 100. Perforations 130 may alternatively be placed elsewhere on board 100.

Figure 2A:
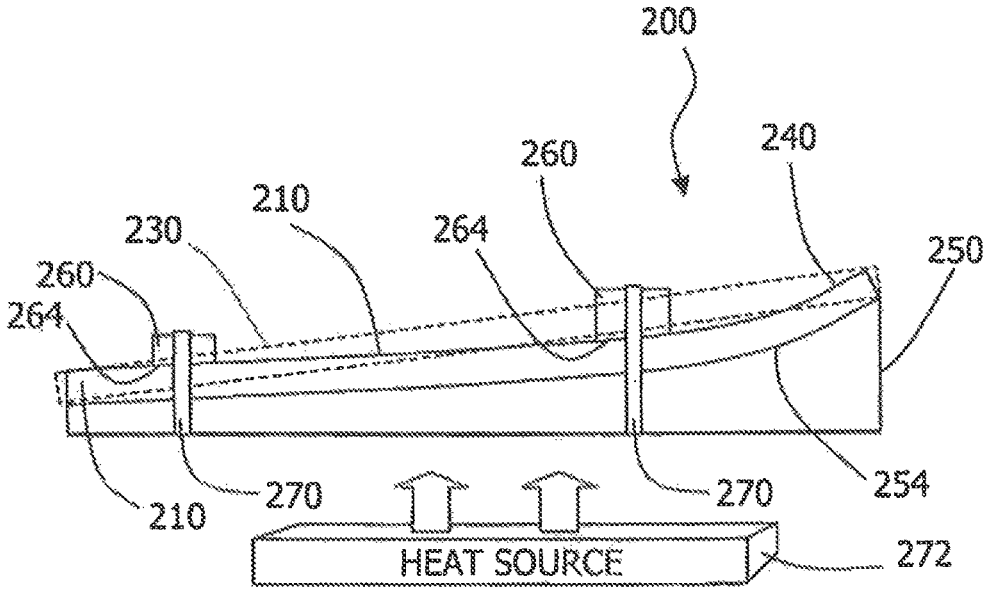
FIG. 2A is a side view of the Improved Surfboard And Method Of Manufacturing of the present invention, showing how a blank is curved by restraining it against a form with restraining tools and straps, and subjected to a heat source.

Referring to FIG. 2A, an apparatus for shaping a blank is shown and generally designated 200. FIG. 2A shows a blank (or foam body or block) 210. Blank 210 may be made of closed-cell extruded polystyrene foam. Such a blank 210 is made by extruding closed-cell polystyrene foam into a foam body of the desired shape. Blank 210 may alternatively be made of other materials having strength similar to closed-cell foam.

FIG. 2A shows two positions for blank 210, an initial position 230 (shown in dashed lines) and a shaped position 240. FIG. 2A also shows a form (or form tool or mold) 250 having a shaped form surface 254. Shaped form surface 254 has a shape in which blank 210 is desired to be shaped. FIG. 2A also shows restraining tools 260 each having a restraining tool surface 264 corresponding to shaped form surface 254 in the manner in which blank 210 is desired to be shaped. Straps 270 extend from form 250 to tools 260 and are tightened to bring tools 260 toward form 250 to capture blank 210 between the tools 260 and the form 250.

Blank 210 may be shaped in the following manner. Blank 210 is initially placed in initial position 230 (shown in dashed lines) upon shaped form surface 254 of form 250. Restraining tool surface 264 of each restraining tool 260 is placed upon blank 210. Straps 270 are attached to restraining tools 260 and to form 250. Tension is applied to straps 270 such that each restraining tool surface 264 is pressed against blank 210, and blank 210 is pulled toward and pressed against shaped form surface 254 of tool 250. At the same time, heat may be applied to blank 210 from heat source 272.

The application of heat and tension to blank 210 causes blank 210 to be conformed to shaped form surface 254 of form 250 and to restraining tool surfaces 264. In a preferred embodiment, the heat provided by heat source 272 may not exceed 180 degrees Fahrenheit, and for an exposure period of less than 30 minutes. Outside temperature variations and humidity may affect the heat levels and duration applied to form the blank 210. Other heating periods and temperatures may be used, however, without departing from the present invention. Rather, the specific temperature and time periods are merely exemplary of a preferred embodiment, and no limitation is intended. Once heated, blank 210 is then allowed to cool until it holds the shape of shaped form surface 254 of form 250 and restraining tool surfaces 264 in shaped position 240 without being pressed against shaped form surface 254 or restraining tool surfaces 264. Restraining tools 260 and straps 270 are then removed from blank 210, and blank 210 is removed from form 250. Form 250 and restraining tools 260 are made of one or more materials that can withstand pressure and heat required to shape blank 210. In a preferred embodiment, form 250 may be made from wood or metal, and restraining tools 260 may be made from wood or metal, however, other materials having suitable strength and resistance to moisture may be used.

While two restraining tools 260 have been shown in FIG. 2A, it is to be appreciated that any number of restraining tools may be used without departing from the present invention. Additionally, restraining tool 260 may extend the length of form 250 such that a single restraining tool 260 is used to capture the entire blank 210.

Figure 2B:
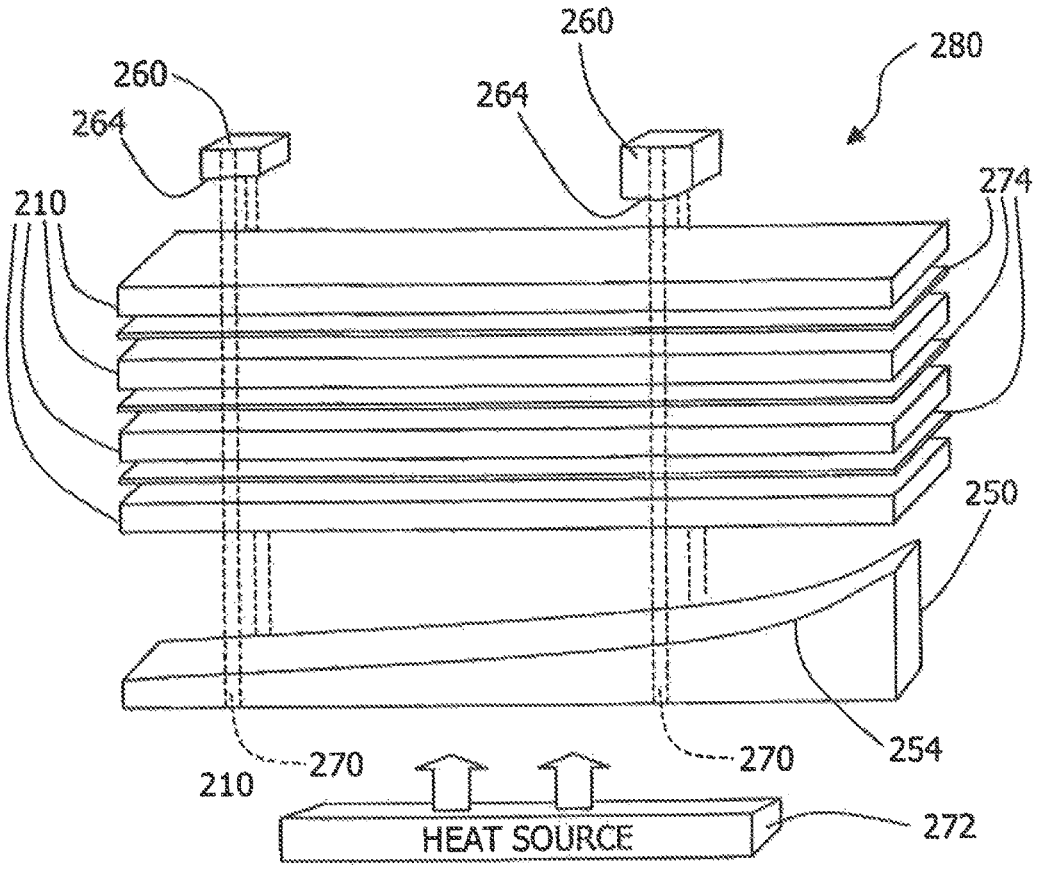
FIG. 2B is an exploded side view of the Improved Surfboard And Method Of Manufacturing of the present invention showing how multiple blanks are simultaneously curved by stacking them vertically, separated by a flexible metal heat-conducting sheet, and restraining the stack against a form with restraining tools and straps, and subjecting the stack to a heat source.

Referring now to FIG. 2B, an exploded side view of the Improved Surfboard and Method of Manufacturing of the present invention is shown and generally designated 280. In apparatus 280, multiple blanks 210 that are substantially rectangular blocks are vertically stacked together and separated by a flexible metal heat-conducting sheet 274. The stack of blanks 210 and sheets 274 are positioned over form 250. Once in position, restraining straps 270 are attached to tools 260 and the straps 270 are tightened such that the stack of blanks 210 and sheets 274 are brought tightly against form 250. As the straps 270 are tightened, the blanks 210 and sheets 274 are deformed to match the curvature of tools surfaces 264 and form 250. When the blanks 210 are in the proper form against form 250, heat is supplied by heat source 272 for a predetermined period of time. At the end of that heating time period, the heat source is removed, and the straps are removed, yielding several blanks 210 having the curvature of curved surface 254 of form 250.

Flexible metal heat-conducting sheet 274, in a preferred embodiment, is made from aluminum, however, it is to be appreciated that other materials having similar flexibility and heat transfer characteristics may be used. The sheet 274 provides for separation between blanks 210 as well as conducts heat from heat source 272. The conduction of heat between blanks 210 is important because blanks 210, by their nature, are good heat insulators. By providing a heat conduction path between blanks 210 in the stacked configuration, each blank is exposed to sufficient heat across its entire surface during the heating period to provide for the formation of blank 210 into the curved form 240 (shown in FIG. 2A).

Figure 2C:
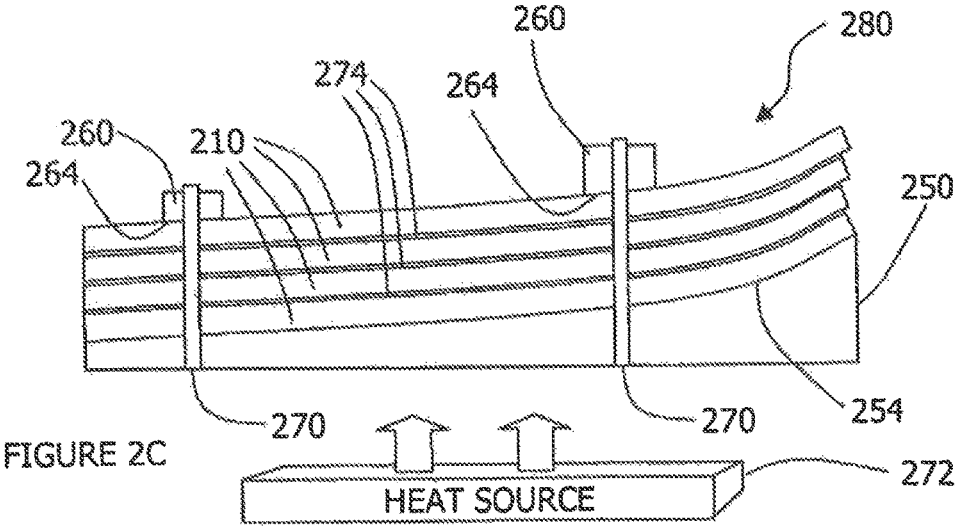
FIG. 2C is a side view of the Improved Surfboard And Method Of Manufacturing of the present invention, showing how multiple blanks are simultaneously curved by stacking them vertically, separated by a metal flexible heat-conducting sheet, and restraining the stack against a form with restraining tools and straps, and subjecting the stack to a heat source.

Referring now to FIG. 2C, a side view of the Improved Surfboard and Method of Manufacturing of the present invention 280 is shown. This figure depicts the process by which multiple blanks 210 are simultaneously curved by stacking them vertically, separated by a metal flexible heat-conducting sheet 274, and restraining the stack against a form 250 with restraining tools 260 and straps 270. Once blanks 210 are in the proper position against curve 254 of form 250, the entire stack of blanks 210 and sheets 274 is subjecting to a heat from heat source 272, such as steam.

Figure 3:
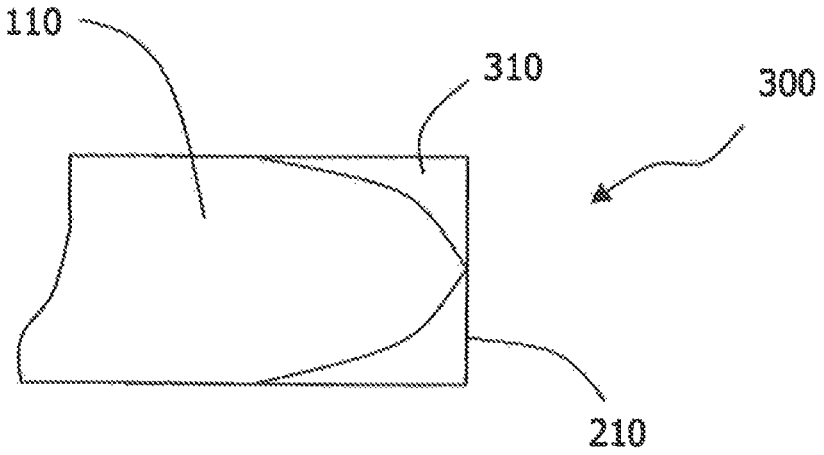
FIG. 3 is a top view of the Improved Surfboard and Method of Manufacturing of the present invention, showing how the blank is cut into a surfboard shape using a hot wire.

FIG. 3 shows a configuration for cutting blank 210 into a desired shape, generally designated 300. More specifically, FIG. 3 shows blank 210 with portions 310 cut away from blank 210 to shape a nose of a board of the present invention. In a preferred embodiment, cut 310 is formed by a hot wire (not shown in FIG. 3) that is known in the art. FIG. 3 shows cut 310 as being in a surfboard shape. Blank 210 may also be shaped by various methods including, without limitation, further heating, further pressing, further cutting, sanding, grinding, smoothing, and other shaping techniques known in the art. After blank 210 has been finally shaped, it may be referred to as a core 110 as discussed in conjunction with FIG. 1.

Figure 4:
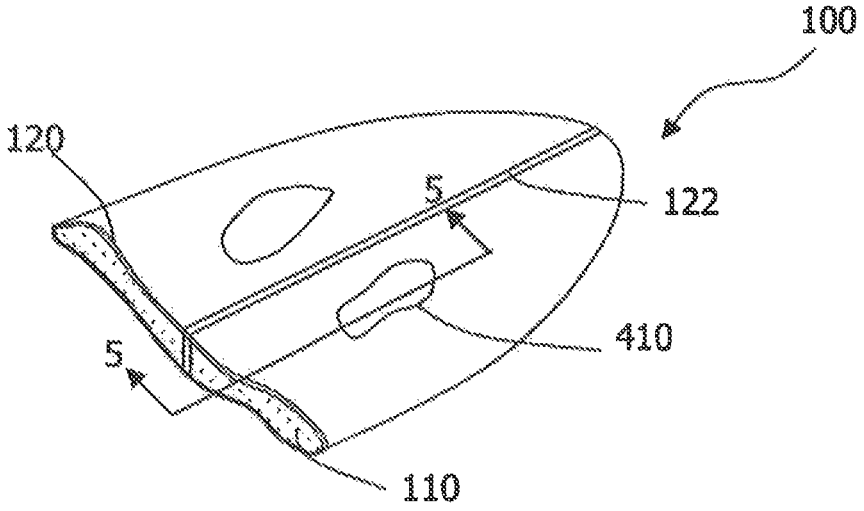
FIG. 4 is a perspective view of the Improved Surfboard And Method Of Manufacturing of the present invention, showing a cut-away view of the interior of the board and showing how busters are formed in the surface of the board without perforations formed in the laminate.

Referring now to FIG. 4, a cut-away view of board 100 is shown and reveals core 110 having a stringer 122. Stringer 122 is typically made of wood, extends the length of core 110, and provides stiffening to the board 100. After core 110 has been formed, it is covered with a sealing material, such as FIBERGLAS® and epoxy resin, which form laminate 120. This sealing material makes board 100 more durable, and provides a water-proof covering. FIG. 4 also shows bubbles or blisters 410 caused by air or gas pockets 420 (see FIG. 5) that can form between core 110 and laminate 120 following use of the board.

Figure 5:
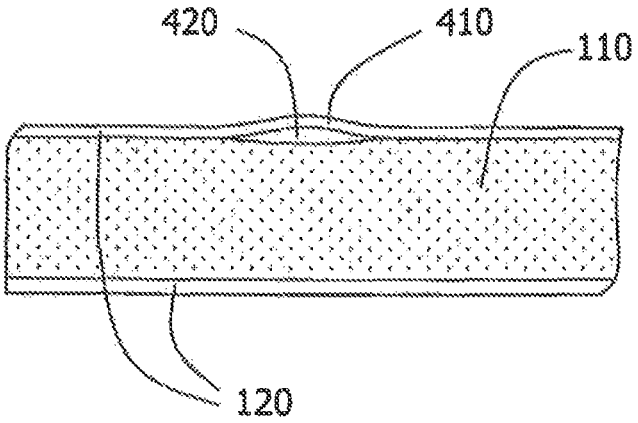
FIG. 5 is a cross-sectional view of the Improved Surfboard and Method of Manufacturing of the present invention, taken across line 5-5 of FIG. 4, showing an air, or gas, blister.

Referring to FIG. 5, a cross-sectional view of board 100 taken across line 5-5 of FIG. 4 is shown. Specifically, FIG. 5 shows air blister or bubble 410 caused by air pocket 420 between core 110 and laminate 120. For instance, when a user stands on board 100, the pressure of his feet upon board 100 can cause localized deformation to the foam. This deformation causes air pockets 420 to form between core 110 and laminate 120 in that general location. Each air pocket 420 causes the area of laminate 120 adjacent to air pocket 420 to separate away from core 110, causing a raised area or "blister" 410 in laminate 120.

Air blisters 410 may form where the user places his feet on board 100, however, blisters 410 can also be caused by other sources of pressure upon board 100 and at other places on board 100. Each air blister 410 causes a deformation of laminate 120, which can damage laminate 120 and decrease the strength of board 100 making it more difficult to use. Additionally, exposure of the board 100 to heat sources, such as the sun, may cause the formation of air blisters 410 between the core 110 and the laminate 120 when the board is not properly vented.

Figure 6:
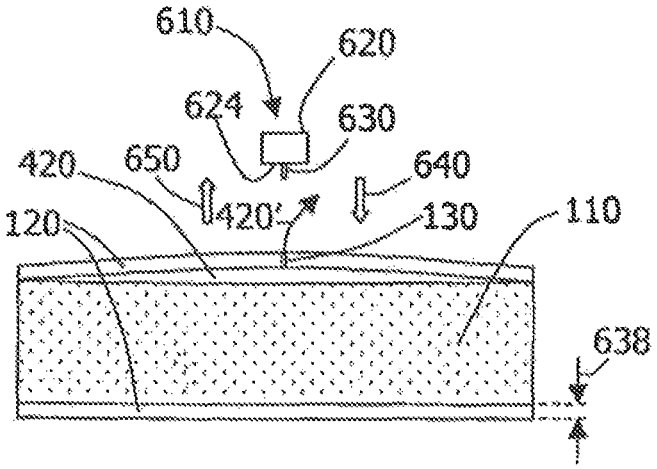
FIG. 6 is a top view of the Improved Surfboard and Method of Manufacturing of the present invention, showing how perforations formed in the laminate by a perforation tool, prevent formation of blisters by allowing any air or gas to escape through the perforation.

FIG. 6 shows another cross-sectional view of board 100 similar to FIG. 5, but with at least one perforation vent 130 now formed in laminate 120 to the pressure in air pocket 420 to escape, thus reducing the size of air pocket 420, and in turn reducing or eliminating blister 410. The perforation vents 130 help avoid deformation and damage to laminate 120, and helps maintain the utility of board 100. Each perforation vent 130 is large enough to allow air to pass through it, and small enough to allow little to no water to pass through it. Thus, each perforation 130 allows air to get out from between laminate 120 and core 110, but allows little water or no water to get in between laminate 120 and core 110.

In a preferred embodiment, perforations 130 are formed through laminate 120 of board 100 at the time of manufacturing and prior to use, and thus, prior to the formation of any bubbles or blisters 420. As a result, there is little or no chance for a blister to form, because any air or gas that develops between laminate 120 and core 110 escapes through perforation 130 before it can develop into a blister 410. As used herein, it is to be understood that "little water" comprises the meanings of "no water" and "substantially no water" as well as the meaning of "a very small amount of water more than no water." No measurable or significant weight change is caused by any moisture absorption into the surfboard or surf craft.

Each perforation vent 130 is formed by a perforating tool 610 which has a perforating tool body 620 having a working surface 624, and at least one perforation needle 630 extending from working surface 624. Each perforation vent 130 is formed as follows. Working surface 624 is placed adjacent laminate 120 and perforating tool 610 is manipulated such that at least one needle 630 is translated in the direction 640 toward board 100 until needle 630 penetrates (or perforates) laminate 120 to form an airway, or vent 130, through the laminate 120.

Perforating tool 610 is then manipulated such that each at least one needle 630 is then translated in the direction 650 opposite the direction 640 in which needle 630 points, and needle 630 is withdrawn from laminate 120, leaving a perforation, or vent, 130 formed in laminate 120 by each needle 630 that penetrates laminate 120. In a preferred embodiment of the present invention, each needle 630 does not penetrate core 110. In an alternative embodiment of the present invention, at least one needle 630 at least partially penetrates core 110.

Needles 630 may be made of stainless steel. Needles 630 may alternatively be made of any other material having sufficient strength to perforate laminate 120. In a preferred embodiment of the present invention, at least one needle 630 is heated to facilitate penetration of laminate 120. If needles 630 are heated, they may be heated to a range of 200 to 250 degrees F. Alternatively, needles 630 may be heated to a temperature in the range from zero degrees Kelvin to the melting point temperature of the material of which the needles 360 are made. In an alternative embodiment of the present invention, each needle 630 is not heated.

In an alternative embodiment, needles 630 may be formed with grooves or threads 635 like a traditional drill bit having a small diameter. In such an embodiment, perforating tool 610 may be capable of rotating needle 630 to bore a perforation vent 130 through laminate 120.

Figure 7:
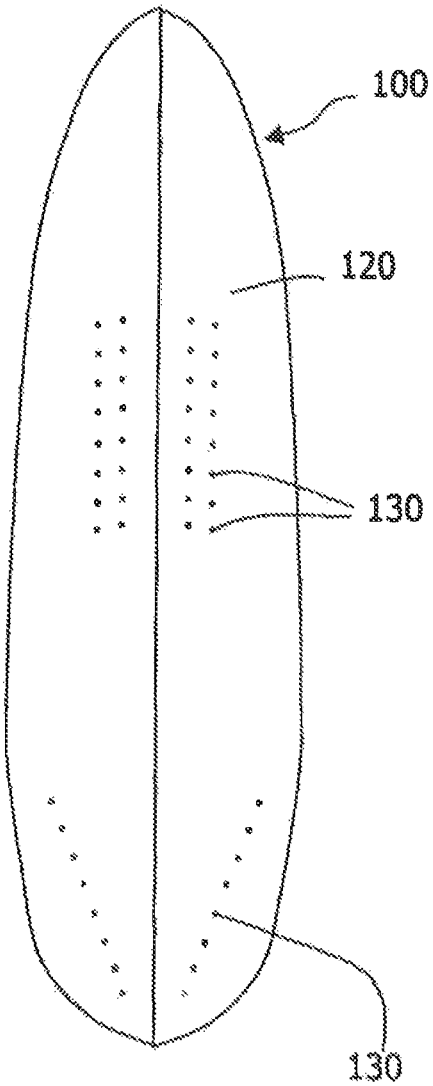
FIG. 7 is a top view of the Improved Surfboard and Method of Manufacturing of the present invention, showing a pattern of perforations in the surface of a short board.

FIG. 7 is a top view of board 100. Board 100 shown in FIG. 7 is a short board. An array of perforations 130 are placed where a user would likely place his or her feet on board 100. Perforations 130 may alternatively be placed in any other location on board 100, such as next to the rails of the surfboard.

Figure 8:
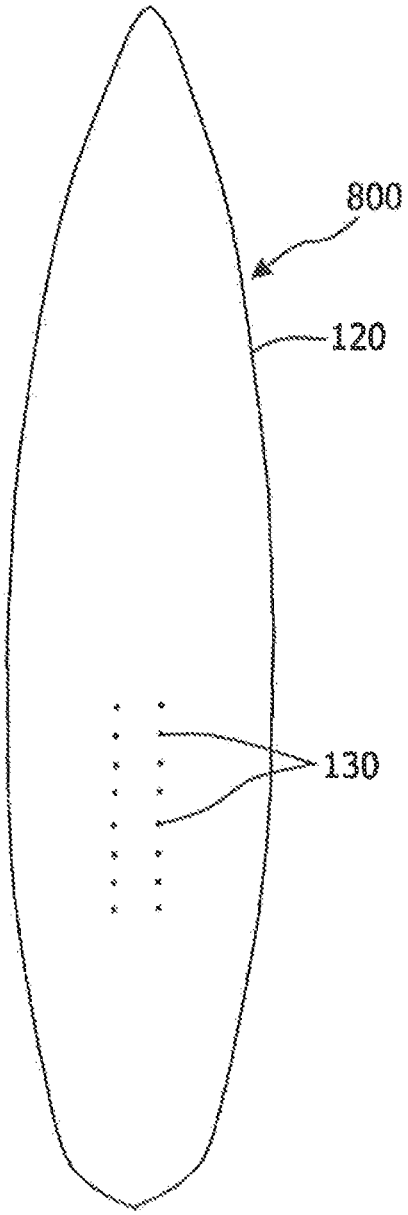
FIG. 8 is a top view of the Improved Surfboard and Method of Manufacturing of the present invention, showing a pattern of perforations in the surface of a long board.

Referring now to FIG. 8, a top view of another embodiment of the Improved Surfboard and Method of Manufacturing of the present invention is shown and generally designated 800. This embodiment is a typical long board and has perforations 130 in locations where a user is likely to place his or her feet on this type of board 800. Perforations 130 may alternatively be placed in any other location on board 800.

Figure 9:
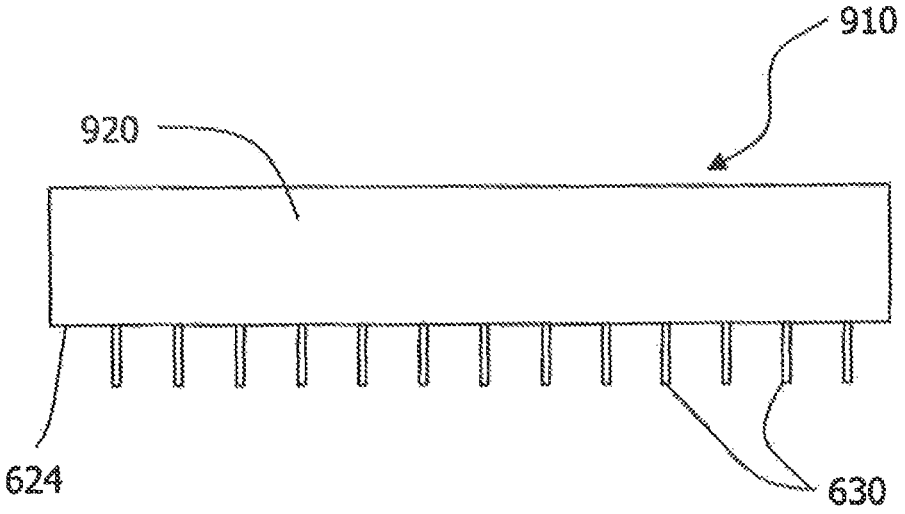
FIG. 9 is a side view of the Improved Surfboard And Method Of Manufacturing of the present invention, showing a perforating tool having a substantially planar working surface, and a number of perforating needles extending perpendicularly from the planar working surface.

FIG. 9 is a side view of another embodiment of a perforating tool generally designated 910. Tool 910 includes a flat body 920 having a flat working surface 624 and multiple perforating needles 630.

FIG. 9 shows needles 630 as substantially parallel to each other, and extending from working surface 624 at an angle substantially perpendicular to working surface 624 at the point where needle 630 intersects working surface 624. In an alternative embodiment, each needle 630 may extend from working surface 624 at an angle other than perpendicular to working surface 624 at the point where needle 630 intersects working surface 624.

Figure 10:
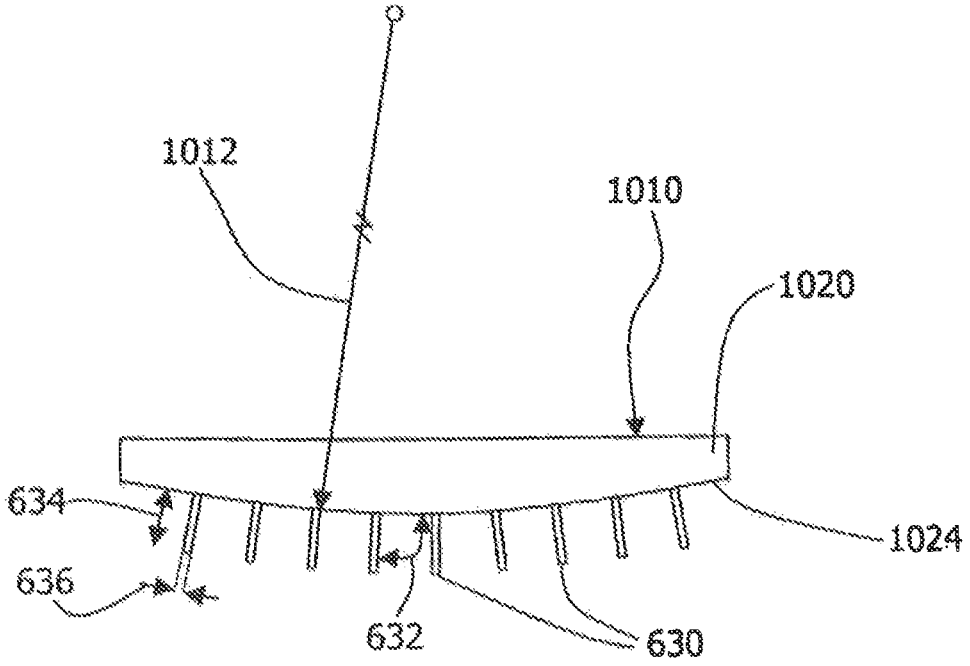
FIG. 10 is a side view of the Improved Surfboard And Method Of Manufacturing of the present invention, showing a perforating tool having a curved working surface and a number of perforating needles extending perpendicularly from the curved working surface.

Referring now to FIG. 10, a side view of another embodiment of a perforating tool is shown and generally designated 1010. Tool 1010 includes a body 1020 having a curved working surface 1024 with a radius 1012, and multiple perforation needles 630 extending radially away from the curved working surface 1024.

FIG. 10 shows each perforation needle 630 as being at an angle 632 to body 1020. In a preferred embodiment, this angle 632 is ninety degrees (90°) as dictated by its radial placement on the curved working surface 1024. FIG. 10 also shows each needle 630 as being substantially perpendicular to curved working surface 1024 at the point where needle 630 intersects curved working surface 1024. In an alternative embodiment, each needle 630 may be at an angle 632 other than perpendicular to curved working surface 1024 at the point where needle 630 intersects curved working surface 1024.

As shown in FIG. 10, each perforation needle 630 has a length 634 and a diameter 636. In a preferred embodiment, length 634 is slightly longer than the thickness 638 of laminate 120 (as shown in FIG. 6). Also, in a preferred embodiment, thickness 638 may be {fraction (1/8)} to {fraction (3/16)} inch or more, and length 634 may be {fraction (3/16)} inch (0.1875") or more, so long as the length 634 is equal to or greater than thickness 638.

The diameter 636 of perforation needle 630 may vary between 0.005 inches and 0.05 inches, and in a preferred embodiment, is 0.008 inches. It is to be appreciated that although perforation needle 630 has been depicted in the Figures as a cylindrical needle, no limitation as to the cross-sectional shape is intended. To the contrary, the cross-sectional shape of the perforation needle 630 may vary, including but not limited to, oval, rectangular, square, or other shapes. Regardless of the cross-sectional shape of perforation needle 630, the cross-sectional area of vent 130 remains small enough to allow the exit of gasses collecting between material 120 and core 110.

Figure 11:
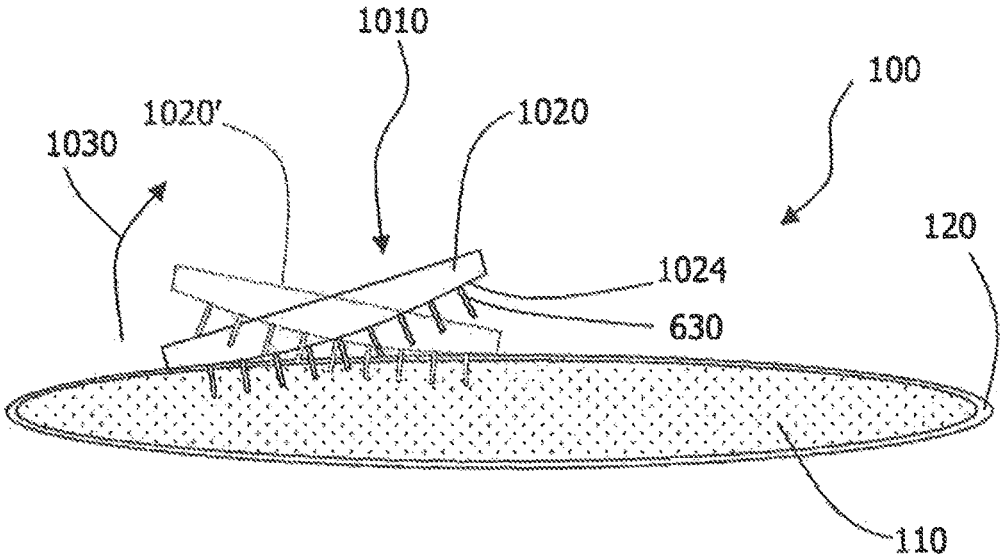
FIG. 11 is a side view of the Improved Surfboard and Method of Manufacturing of the present invention, showing a cross-section of a board with a curved perforating tool perforating the laminate of the board.

FIG. 11 shows how curved perforating tool 1010 is used to make a row of perforations 130. FIG. 11 shows a cross section of a surfboard of the present invention, with curved perforating tool 1010 positioned adjacent board 100. In use, curved working surface 1024 is placed adjacent laminate 120 such that at least one needle 630 penetrates laminate 120. Curved working surface 1024 is then "rolled" in direction 1030 across laminate 120 to a second position 1020' (shown in dashed lines) such that each perforation needle 630 successively penetrates and is then withdrawn from laminate 120, leaving a perforation vent where each needle 630 has penetrated laminate 120. FIG. 11 shows curved working surface 1024 as contacting laminate 120.

Alternatively, curved perforating tool 1010 can be manipulated such that curved working surface 1024 do not actually contact laminate 120 thereby avoiding any damage to laminate 120 from perforating tool 1010. For instance, as curved perforating tool 1010 is rolled clockwise above laminate 120, each needle 630 rotates as the tool 1010 is translated, such that each needle 630 remains substantially perpendicular to laminate 120 as it forms perforation vent 130. This is particularly useful when tool 1010 is heated, and contact between tool 1010 and laminate 120 may cause marks or blemishes to form.

In FIG. 11, curved working surface 1024 is curved in at least one dimension of curved working surface 1024. FIG. 11 shows curved working surface 1024 as substantially convex. Alternatively, curved working surface 1024 can be at least partially concave without departing from the present invention. In a preferred embodiment, the curve of curved working surface 1024 is substantially an arc of a circle that has a radius 1012 (see FIG. 10), in at least one dimension of curved working surface 1024. Alternatively, curved working surface 1024 can have a curve that is other than circular, including, without limitation, parabolic, hyperbolic, or any combination thereof.

Figure 12:
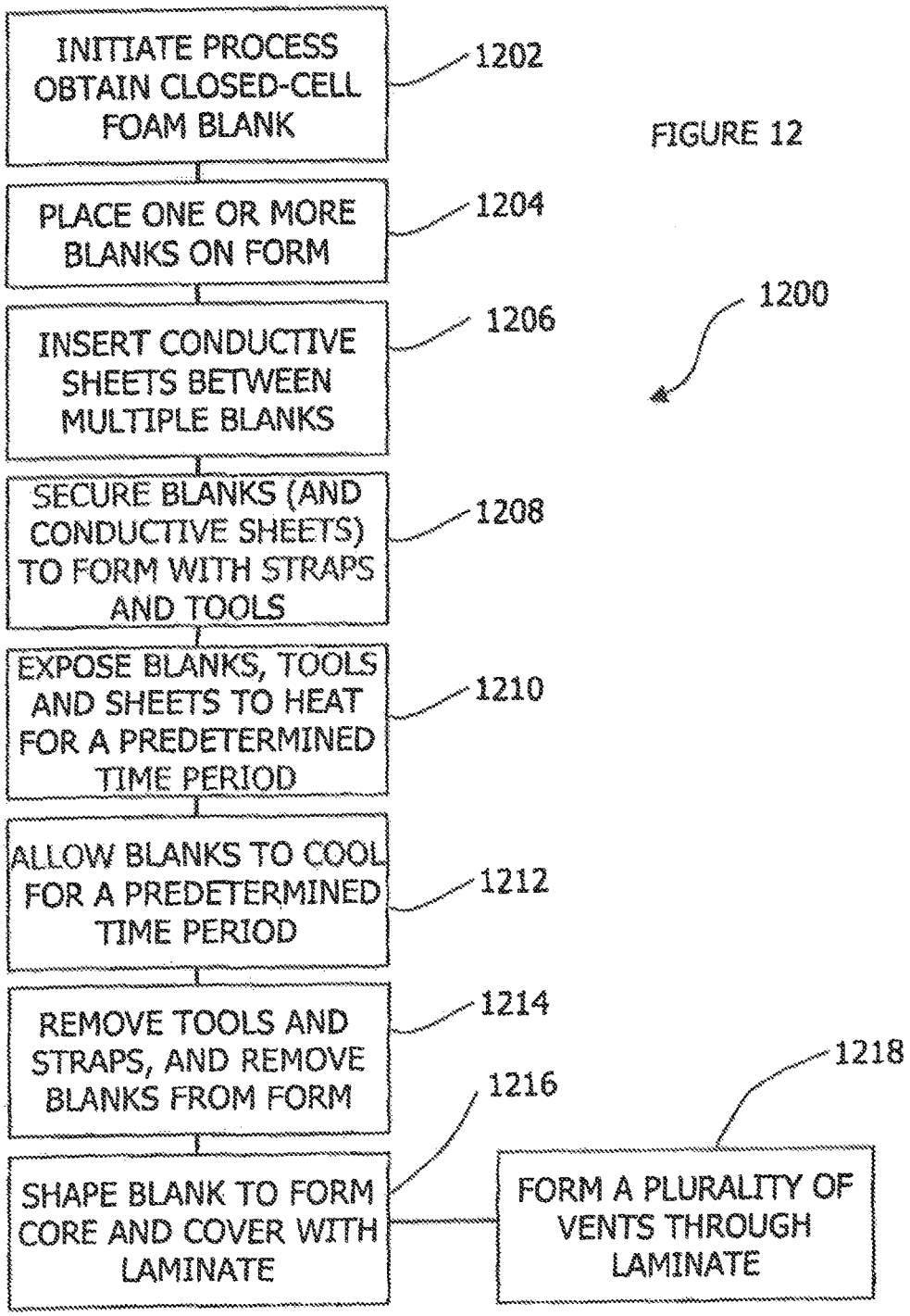
FIG. 12 is a flow chart representing an exemplary process of the present invention for manufacturing the Improved Surfboard of the present invention.

Referring now to FIG. 12, a flow chart representing a preferred method of manufacturing an Improved Surfboard of the present invention, and is generally designated 1200. Method 1200 includes a first step 1202 in which one or more closed-cell foam blanks is obtained, and then placed on the form in step 1204. Once on the form, conductive sheets are inserted between the blanks in step 1206, and the blanks and conductive sheets are secured to the form using tools and straps in step 1208.

The assembly of tools, blanks separated by sheets, and secured to the form, is then exposed to heat from a heat source for a predetermined time period in step 1210. At the expiration of that time period, the assembly is cooled for a second predetermined time period in step 1212. Once cooled, the tools and straps are removed, and the blanks are removed from the form and separated from the conductive sheets in step 1214.

Once thoroughly cooled, the now-formed blanks are shaped to form a core and covered with sealing material in step 1216. Once the sealing material is dry, a number of vents are formed through the sealing material in final step 1218 to yield an Improved Surfboard of the present invention.

Figure 13:
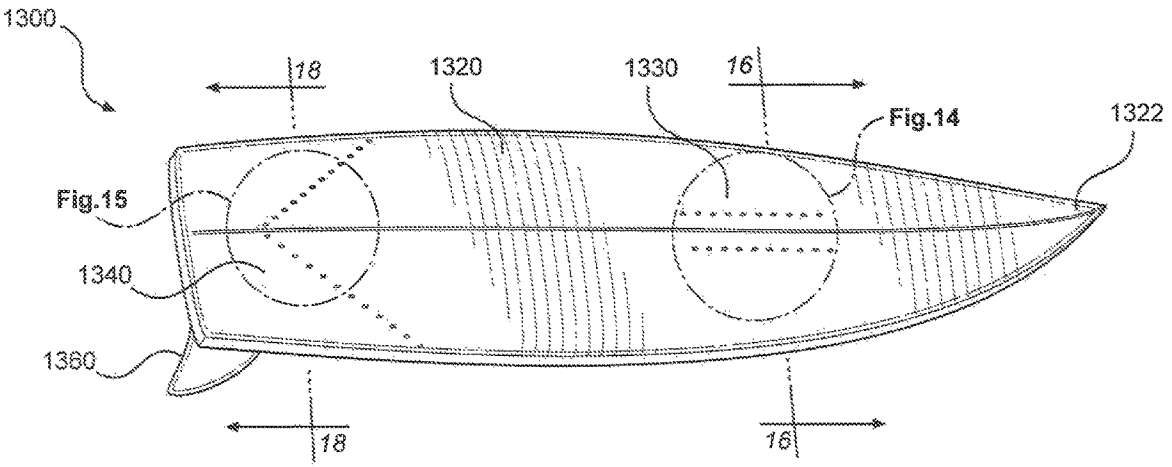
FIG. 13 is a perspective view of an alternative embodiment of the Improved Surfboard of the present invention, showing an alternative embodiment of a finished board having deck perforations and tail perforations.
Figure 14:
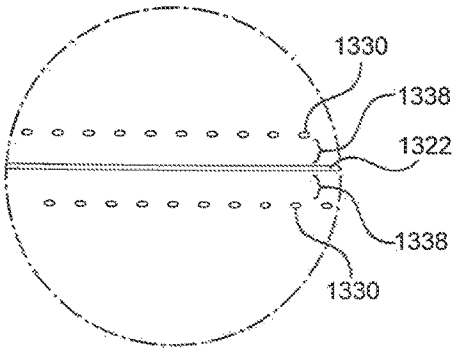
FIG. 14 is a close-up view of the deck perforations showing a pair of seven perforations on both sides of the stringer and arranged in a straight-line parallel with the board's stringer.
Figure 15:
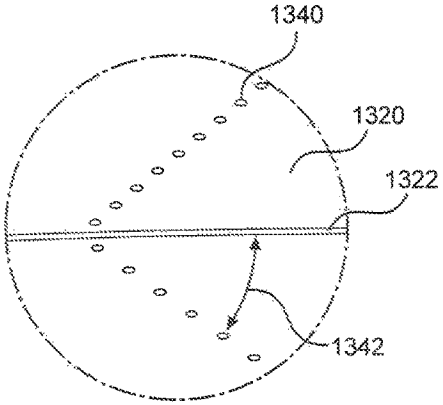
FIG. 15 is a close-up view of the tail perforations showing a pair of seven perforations on both sides of the stringer and arranged in a straight line at a forty-five degree angle with the board's stringer.

An alternative embodiment of the Improved Surfboard of the present invention is shown in FIG. 13 and is generally designated 1300. As shown in FIG. 13, in conjunction with FIG. 14-18, Board 1300, includes a foam core 1310 (not shown, see FIG. 16), a laminate 1320 covering core 1310 having a stringer 1322, and is formed with deck perforations 1330 in laminate 1320 and tail perforations 1340 in laminate 1320. Board 1300 may have one or more optional fins 1360.

Figure 16:
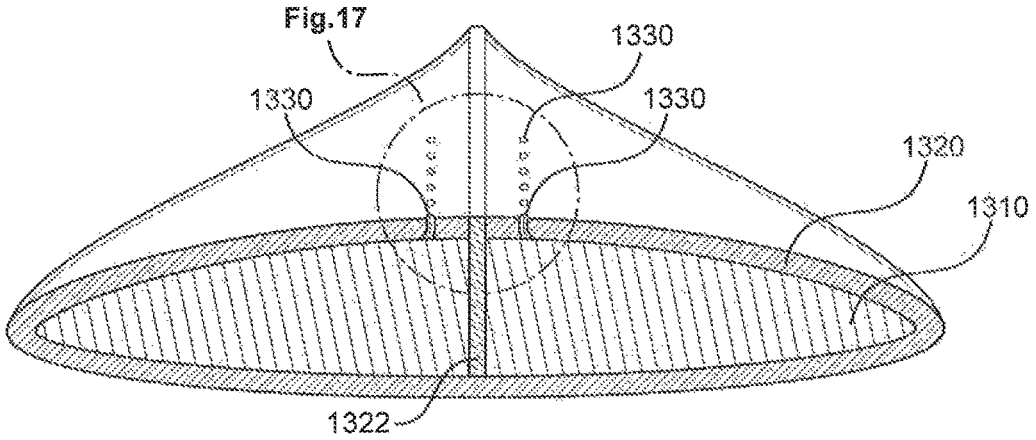
FIG. 16 is a cross-sectional view of the board taken along line 16-16 of FIG. 13.
Figure 17:
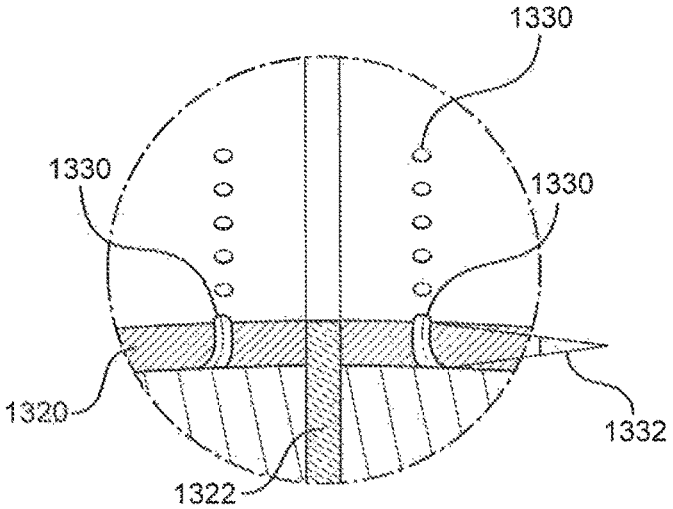
FIG. 17 is a close-up view of the cross-sectional view of the board taken along line 16-16 of FIG. 13 showing the curved perforations of the deck perforations.

The deck perforations 1330 are formed in the deck area of the board 1300, preferably towards the centerline of the board 1300. The deck perforations 1330 include seven (7) individual perforations arranged in a straight line and parallel with the stringer 1322 on each side of the stringer 1322 for a total of fourteen (14) perforations. The deck perforations 1330 are located on both sides of the stringer 1322 with each of the seven (7) individual perforations arranged in a straight line spaced a deck perforation distance 1338 (see FIG. 14) from the stringer 1322. In the preferred embodiment, the deck perforation distance 1338 is three inches. As shown in FIGS. 16 and 17, the deck perforations 1330 are curved and have a deck perforation curve 1332.

Figure 18:
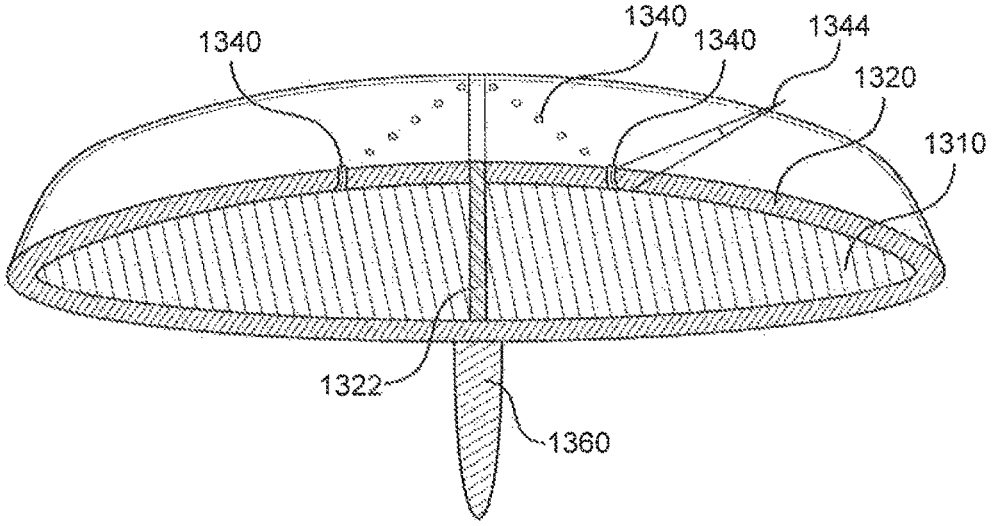
FIG. 18 is a cross-sectional view of the board taken along line 18-18 of FIG. 13.

The tail perforations 1340 are formed in the tail area of the board 1300, preferably towards the back of the board 1300. The tail perforations 1340 include a pair of seven (7) individual perforations arranged in a straight line and at a tail perforation angle 1342, preferably tail perforation angle 1342 is at a forty-five degree angle with the stringer 1330. Each of the seven (7) individual perforations arranged in a straight line of the tail perforations 1340 is located on either side of the stringer 1322. As shown in FIG. 13, one of the seven (7) individual perforations arranged in a straight line is on one side of the stringer 1322 and the other on the opposite side of the stringer 1322. As shown in FIG. 18, the tail perforations 1340 are curved and have a tail perforation curve 1344

Figure 19:
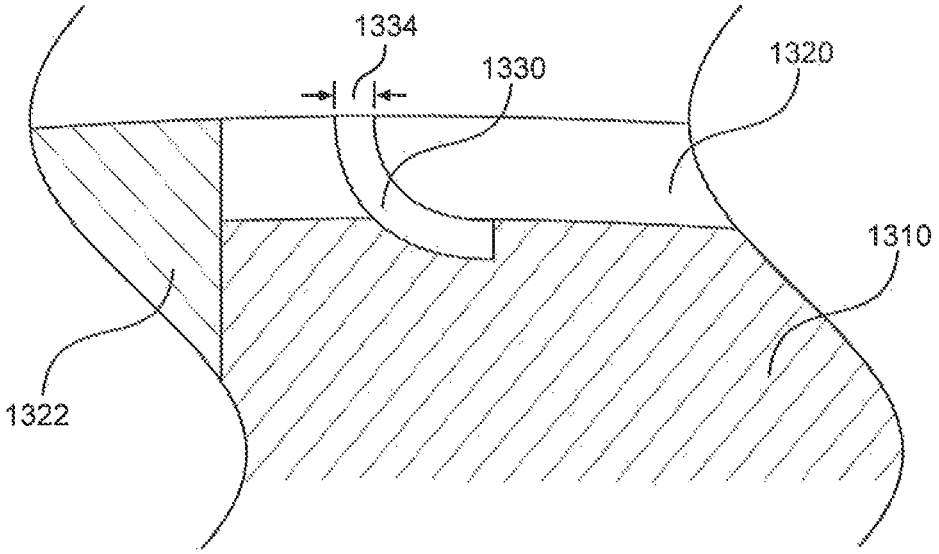
FIG. 19 is a close-up view of a cross-section of a curved perforation.
Figure 20:
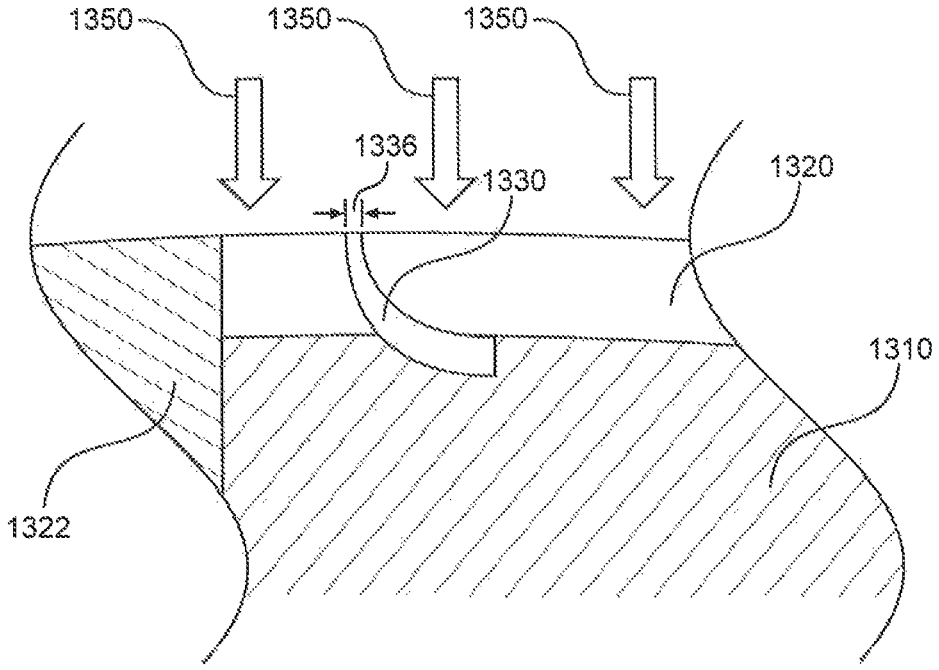
FIG. 20 is a close-up view of a cross-section of a deformed curved perforation under pressure changing the opening size of the curved perforation.

The deck perforation curve 1332 and the tail perforation curve 1344 are substantially the same. The deck perforation curve 1332 and the tail perforation curve 1344 promote the closure of the deck perforations 1330 and tail perforations 1340 when pressure is applied directly on top and/or in the vicinity of the perforations. As shown in FIG. 20, the laminate 1320 is slightly flexible and when a pressure 1350 is applied, such as when a user's feet is pressing down on the board 1300, the laminate 1320 and the core 1310 will deform. The deformation in the laminate 1320 causes the perforations to narrow to a narrow diameter 1336 and in certain circumstances close in on itself. This inhibits fluids from entering the board 1340 while in use by narrowing the opening of the deck perforations 1330 and tail perforations 1340. When not in use, the deck perforations 1330 and tail perforations 1340 revert back to their original and maximum diameter 1334 to allow trapped fluids and gasses to escape from within the board 1300 to the atmosphere as shown in FIG. 19.

Figure 21:
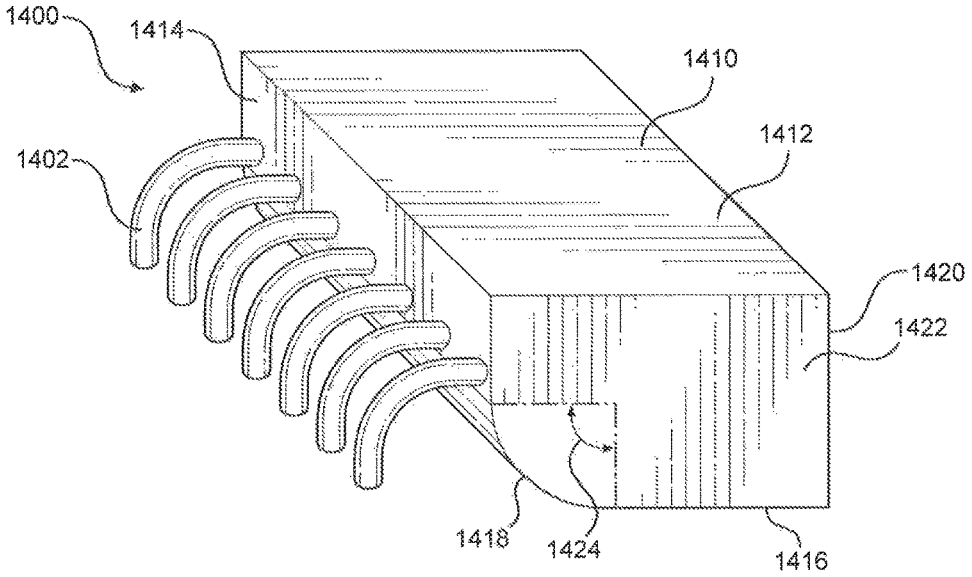
FIG. 21 is a perspective view of an alternative embodiment of the perforation tool including seven perforation needles attached to a curved tool body.
Figure 22:
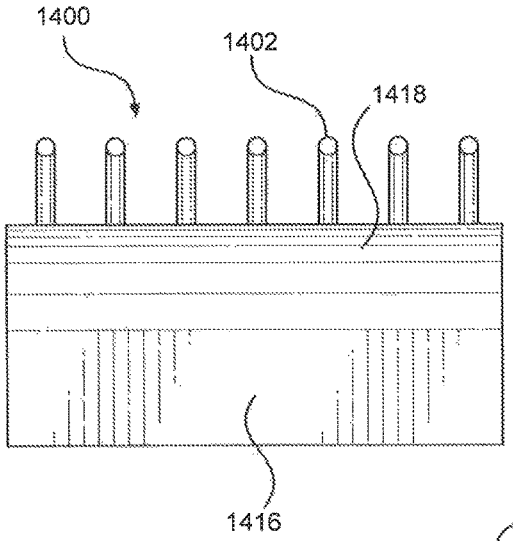
FIG. 22 is bottom view of the perforation tool showing the curved face and protruding perforation needles.
Figure 23:
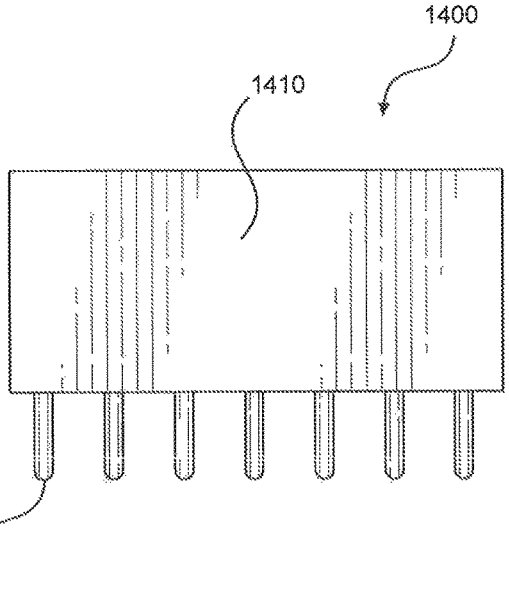
FIG. 23 is a top view of the perforation tool.
Figure 24:
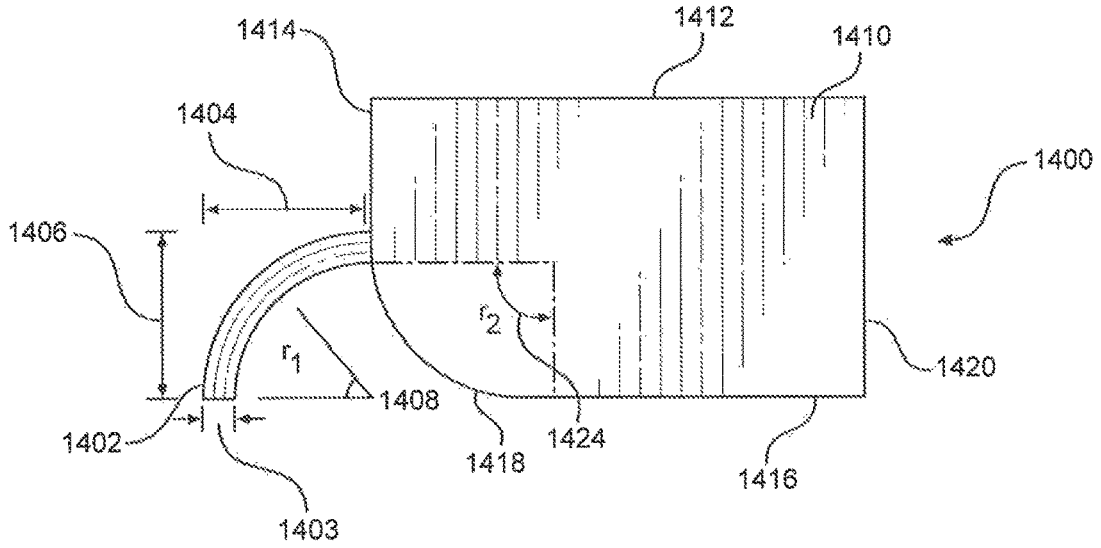
FIG. 24 is a side view of the perforation tool showing the curved perforation needles attached to the tool body at the intersection of the front face and the curved face.

An alternative embodiment of the perforation tool used to manufacture board 1300 is shown in FIG. 21 and generally designated 1400. As shown in FIG. 21, in conjunction with FIGS. 22-24, the perforation tool 1400 includes a tool body 1410 having a generally rectangular shape and a plurality of perforation needles 1402 extending therefrom. The tool body 1410 is made from a material with high thermal resistance whereas the perforation needles 1402 are made from a material with high thermal conductivity.

The tool body 1410 has a top face 1412, a back face 1420, a bottom face 1416, a curved face 1418, a front face 1414, a side faces 1422. The curved face 1418 extends between the bottom face 1416 and the front face 1414 and has a curve angle 1424. In the perforation tool 1400, a total of seven (7) perforation needles 1402 are used. It is to be appreciated by someone skilled in the art that a different number of perforation needles 1402 may be used without departing from the scope and spirit of the present invention. Each perforation needle 1402 has a diameter 1403, a length 1404, a height 1406, and a curve angle 1408. The perforation needles 1402 extend form the tool body 1410 at the point of intersection between the curved face 1418 and the front face 1414 and are equally spaced along the tool body 1410.

The curve angle 1408 of the perforation needles 1402 and the curve angle 1424 of the tool body are equal. Further, the perforation needles 1402 and the curved face 1418 of the tool body have the same arc. As a result, the perforation needles 1402 extend out of the front face 1414 and terminate at a plane created by the bottom face 1416 of the tool body. By utilizing the same arc for the perforation needles 1402 and the curved face 1418 of the tool body it enables the perforation needles 1402 to enter at a single entry point in the laminate 1320 as the perforation needles 1402 penetrates the laminate 1320 and the foam core 1310. The arc also ensures the perforation needles 1402 follow a single path as the tool is rotated along the curved face 1418 of the tool body 1410 and does not sweep in a wide angle as it passes through the laminate 1320.

Figure 25:
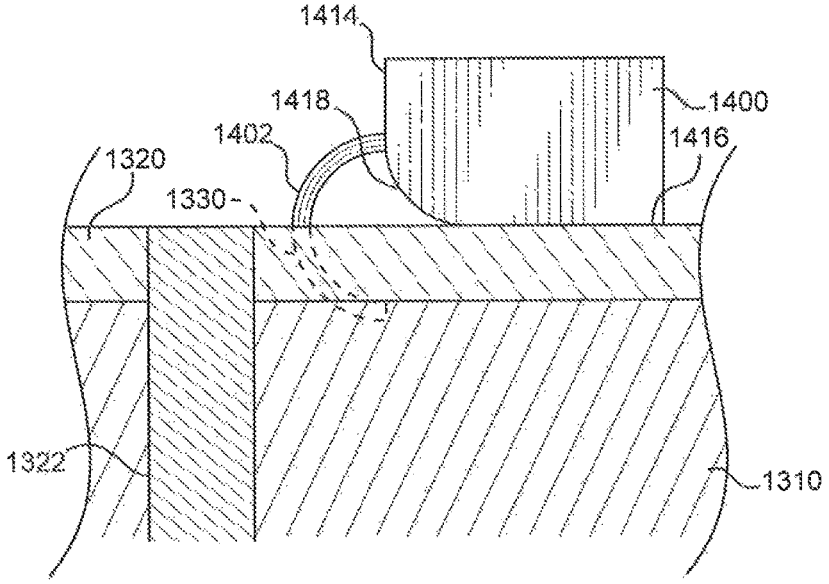
FIG. 25 is a diagram showing the alignment of the perforation tool on a board to create perforations.
Figure 26:
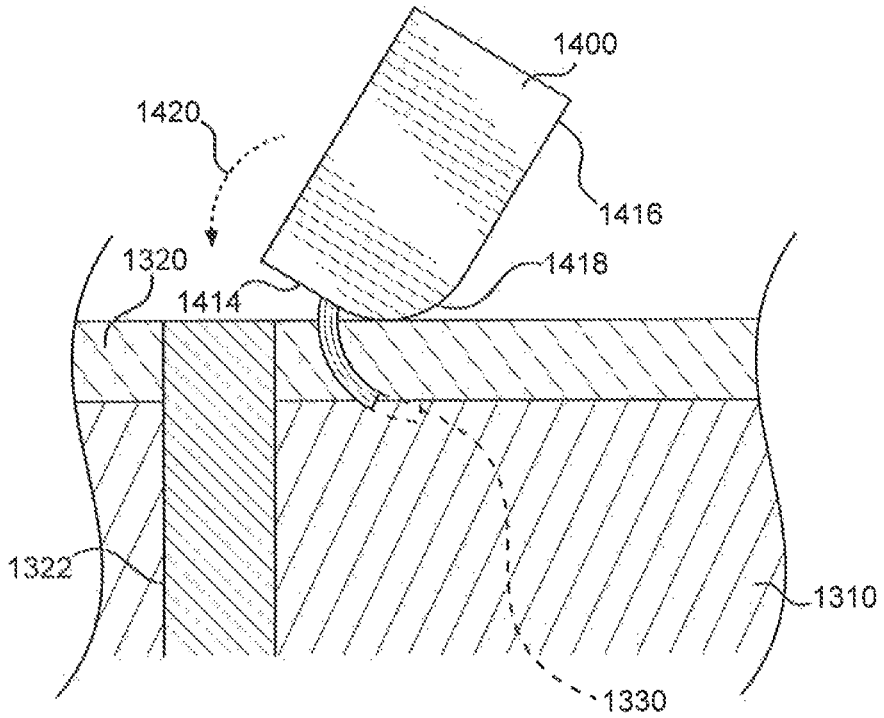
FIG. 26 is a diagram showing the rotation of the perforation tool to penetrate the perforation needles into the laminate of the board to create the perforations.
Figure 27:
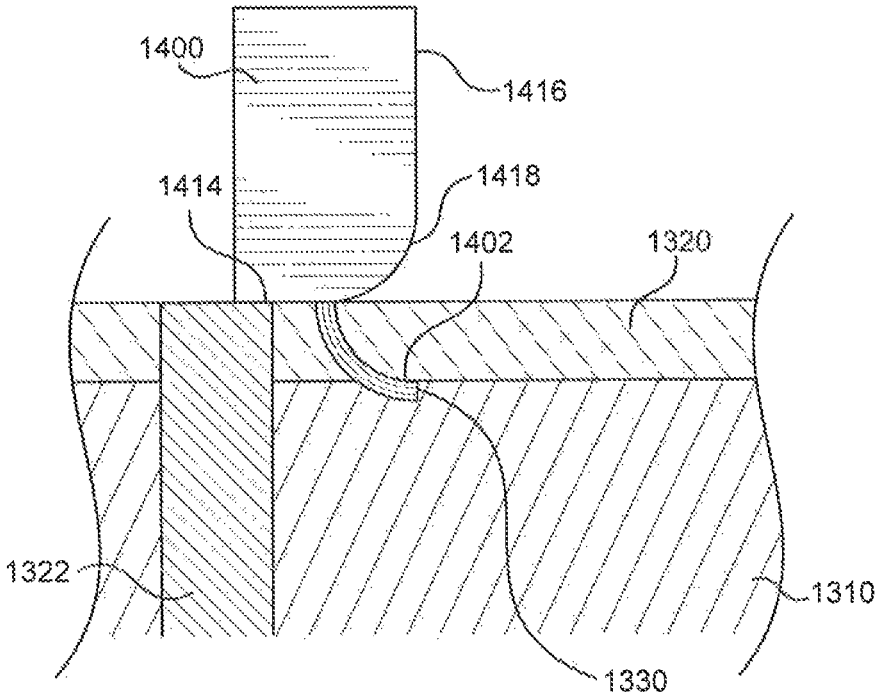
FIG. 27 shows the perforation needles fully penetrating the laminate and a portion of the foam core to create the perforations.

Referring now to FIGS. 25-27, the steps of applying perforations after the foam core 1310 with laminate 1320 in the method of manufacturing board 1300 is shown. To manufacture the foam core 1310 with laminate, the steps are substantially similar to the steps of method 1200 described above and shown in FIG. 12.

Method 1200 includes the first step 1202 in which one or more closed-cell foam blanks is obtained, and then placed on the form in step 1204. Once placed on the form, conductive sheets are inserted between the blanks in step 1206, and the blanks and conductive sheets are secured to the form using tools and straps in step 1208. The assembly of tools and blanks separated by sheets secured to the form is then exposed to heat from a heat source for a predetermined time period in step 1210. At the expiration of that time period, the assembly is cooled for a second predetermined time period in step 1212. Once cooled, the tools and straps are removed, and the blanks are removed from the form and separated from the conductive sheets in step 1214. Once thoroughly cooled, the now-formed blanks are shaped to form a core and covered with sealing material in step 1216. Once the sealing material is dry, a number of vents are formed through the sealing material in steps shown in FIGS. 25-27.

The first step in creating the deck perforations 1330 of the board 1300 is to heat the perforation needles 1402 to allow the perforation needles 1402 to quickly and cleanly penetrate the laminate 1320 and the foam core 1310. The high thermal resistance of the tool body 1410 prevents it from absorbing the heat from the perforation needles 1402 ensuring the perforation needles 1402 stays at operating temperatures. The tool body 1410 stays at a temperature that allows a user to easily handle the perforation tool 1400 to create perforations. As shown in FIG. 25, after the perforation needles 1402 are heated, the perforation tool 1400 is placed on or in close proximity to the laminate 1320 with the perforation needles 1402 located at the desired location of the perforations.

As shown in FIG. 26, the second step is to rotate the perforation tool 1400 counter-clockwise in direction 1420. As the user rotates the perforation tool 1400 in direction 1420, the curved face 1418 of the perforation tool 1400 begins to make contact with the laminate 1320 and the perforation needles 1402 begin to penetrate the laminate 1320 to create, in this particular example, the deck perforations 1330. As the perforation tool 1400 is continually rotated, the curved face 1418 pivots the perforation tool 1400 along the curved face 1418. The arc of the curved face 1418 ensures the perforation needles 1402 follow a single path as the perforation tool 1400 is rotated along the curved face 1418 of the tool body 1410 and does not sweep in a wide angle as it passes through the laminate 1320.

As shown in FIG. 27, the perforation needles 1402 has fully penetrated into the laminate 1320 and the foam core 1310. Once the front face 1414 of perforation tool 1400 contacts the laminate 1320, the penetration needles 1302 have reached their maximum depth. At the perforation needles 1402 maximum penetration depth, the front face 1414 of the tool body 1410 serves as a physical stop to prevent the perforation tool 1400 from further rotation. Once completed, the perforation tool 1400 is rotated in the reverse direction of direction 1420 and removed and the deck perforations 1330 have been created.

Figure 28:
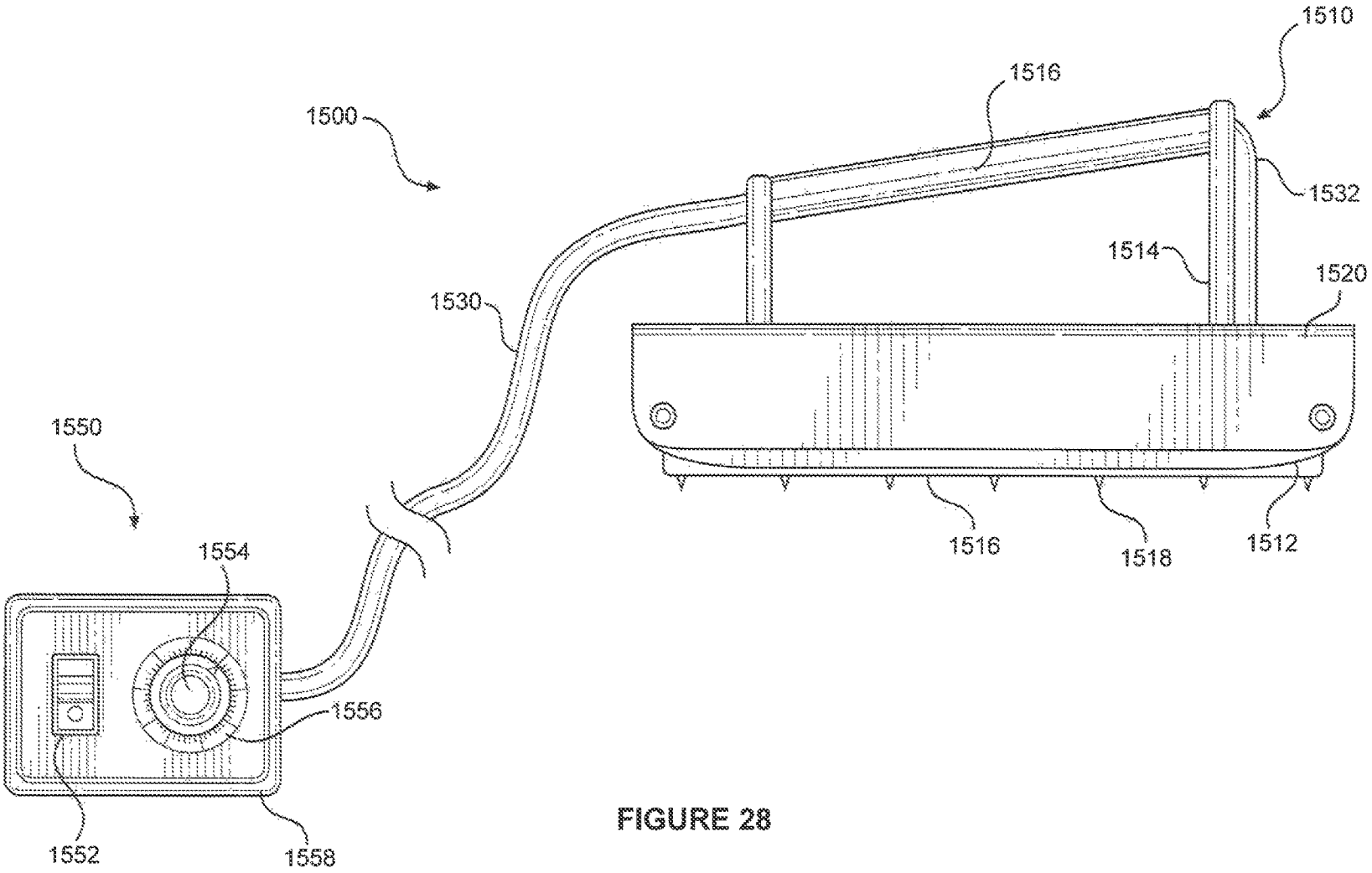
FIG. 28 shows an alternative embodiment of the perforation tool.

Referring now to FIG. 28, an alternative embodiment of the perforation tool is shown and generally designated 1500. The perforation tool 1500 includes a perforator 1510 and a power source 1550. The perforator 1510 is electrically connected to the power source by an electric wire 1530. The electric wire 1530 provides electricity from the power source 1550 to the perforator 1510.

The perforator 1510 includes a base 1512 with handle mounts 1514 attached to the base 1512 and a handle 1516 attached to the handle mounts 1514. Attached to the opposite end of the base 1512 with the attached handle mounts 1514 is a heat conductor 1516 with attached perforation needles 1518. As shown, there are seven (7) perforation needles 1518 equally spaced apart along the heat conductor 1516. The heat conductor 1516 is attached to the electrical wire 1530 with a connector 1532. The heat conductor 1516 converts electrical energy from the power source 1550 to thermal energy to heat up the perforation needles 1518 to the appropriate operating temperature, preferably 180 degrees Fahrenheit. This allows the creation of the perforation in the board in approximately 5 seconds per set of seven (7) perforations for a total time of 20 seconds per surfboard 1300. It is fully contemplated that the configuration, shape, and size of the perforator 1510 may be modified without departing form the spirit and scope of the invention. Particularly, the perforator 1510 may be modified to have the general shape and configuration as shown and described in FIGS. 21-24 for the perforation tool 1400.

Attached to the exterior of the base 1512 are heat shields 1520 to provide an additional layer of insulation to prevent the user and the surfboard from the heat emanating from the base 1512 and the heat conductor 1516. The handle 1516 provides a safe gripping area for the user to manipulate the perforator 1510 to create perforations in the surfboard without the risk of burning oneself. The electrical wire 1530 allows the user to easily move the perforator 1510 independent of the power source 1550.

The power source 1550 includes a base 1558 with a power switch 1552 and an adjustment knob 1554. The power switch 1552 turns the power source 1550 on or off while the adjustment knob 1554 adjusts the power output to the perforator 1510. The adjustment knob 1554 allows the adjustment of the power output to the perforator 1510 to account for variations that may affect the temperature of the perforation needles 1518 such as humidity and ambient temperature. Graduation marks 1556 provide a visual indication of the current power level of the power source 1550.

It is to be appreciated by someone skilled in the art that the specific features of one or more embodiments may be combined with specific features of one or more other embodiments without departing from the scope of the invention.

While the particular Improved Surfboard And Method Of Manufacturing as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

I claim:

1. A surfboard having a deck, comprising:

a closed-cell foam core;

a stringer located internal to, and along the centerline of, the foam core;

a laminate layer covering the core;

a first plurality of perforations in the deck of the laminate layer located near the front of the surfboard where a first portion of the perforations is located on one side of the stringer and positioned in a straight line parallel to the stringer, and a second portion of the perforations is located on the other side of the stringer and positioned in a straight line parallel to the stringer and the first portion of the perforations;

a second plurality of perforations in the deck of the laminate layer near the rear of the surfboard where a first portion of the second plurality of perforations is located on one side of the stringer and positioned in a straight line oriented at an angle to the stringer, and a second portion of the second plurality of perforations is located on the other side of the stringer and positioned in a straight line, wherein the first plurality and the second plurality of perforations are curved such that the perforations penetrate completely through the laminate layer.

2. The surfboard of claim 1, wherein the first portion and the second portion of the second plurality of perforations are positioned at a forty five (45) degree angle from the stringer.

3. The surfboard of claim 1, wherein the first plurality and the second plurality of perforations are configured to allow a top opening of each perforation to close in response to a force applied to the deck of the surfboard in the area of the perforations.

4. The surfboard of claim 3, wherein the first plurality and the second plurality of perforations are configured to allow the top opening of each perforation to open when the force is removed from the deck of the surfboard, thereby allowing any gasses or fluids to escape from the interior of the surfboard.

5. The surfboard of claim 1, wherein the first plurality and the second plurality of perforations are sized to allow gasses to pass through them but allow little or no water through them.

6. The surfboard of claim 1, wherein the core is made from extruded foam.

7. A tool for forming perforations through the lamination layer of a surfboard, the surfboard having a core, a stringer, and a laminate layer covering the core and stringer, the tool comprising:

a body having a top face, a back face, a bottom face, a curved face, a front face, and side faces, where the curved face extends between the bottom face and the front face and has a curve angle; and a plurality of curved perforation needles extending from the front face proximate the intersection of the front face and the curved face and having a curve similar to the curve of the curved face.

8. The tool for forming perforations of claim 7, wherein the plurality of curved perforation needles terminate at a plane created by the bottom face of the tool body.

9. The tool for forming perforations of claim 7, wherein the tool is sized such that the plurality of curved perforation needles fully penetrate the laminate layer and extend into the foam core.

10. The tool for forming penetrations of claim 7, wherein the tool body has a high thermal resistance.

11. The tool for forming penetrations of claim 7, wherein the plurality of curved perforation needles have a low thermal resistance.

12. The tool for forming penetrations of claim 7, wherein the plurality of curved perforation needles are heated to an operating temperature before forming perforations.

13. The tool for forming penetrations of claim 7, wherein the curve of the curved face ensures the plurality of curved perforation needles follow a single path when inserted into, and withdrawn from, the laminate layer.

* * * * *